US009988819B2

(12) United States Patent
Keene

(10) Patent No.: US 9,988,819 B2
(45) Date of Patent: Jun. 5, 2018

(54) ROOF VENTILATION SYSTEM AND METHOD

(71) Applicant: Keene Building Products Co., Inc., Mayfield Heights, OH (US)

(72) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 0 days. days.

(21) Appl. No.: 14/972,462

(22) Filed: Dec. 17, 2015

(65) Prior Publication Data

US 2016/0177574 A1 Jun. 23, 2016

Related U.S. Application Data

(60) Provisional application No. 62/092,872, filed on Dec. 17, 2014.

(51) Int. Cl.
*E04D 13/17* (2006.01)
*E04D 13/064* (2006.01)

(52) U.S. Cl.
CPC ..... *E04D 13/178* (2013.01); *E04D 13/172* (2013.01); *E04D 13/064* (2013.01)

(58) Field of Classification Search
CPC ..... E04D 13/178; E04D 13/064; E04D 5/08
See application file for complete search history.

(56) References Cited

U.S. PATENT DOCUMENTS 4,055,925 A * 11/1977 Wasserman ..... E04D 13/151 428/468
4,534,142 A * 8/1985 Drefahl ..... E04D 11/002 47/65.9
4,805,367 A * 2/1989 Kleckner ..... E04D 13/17 52/199
5,099,627 A * 3/1992 Coulton ..... E04D 13/17 52/408
5,238,450 A * 8/1993 Rotter ..... E04D 13/152 454/260
5,918,425 A * 7/1999 Archard ..... E04D 13/178 52/199
5,960,595 A * 10/1999 McCorsley, III ..... B32B 3/30 156/210

(Continued)

*Primary Examiner* — Rodney Mintz
(74) *Attorney, Agent, or Firm* — Renner, Otto, Boisselle & Sklar, LLP

(57) ABSTRACT

The present disclosure provides a roof ventilation system and method that provides ventilation for a roof while further providing simpler ventilation installation, prevention of ice dams, a non-slip surface to walk on, and a secondary membrane to prevent moisture intrusion into the living space or walls. The roof ventilation system provided by the invention includes vertical side walls having a top portion. A roof extends outwardly and beyond the vertical side walls. The roof has a top surface facing away from the vertical side walls. A web of extruded polymer monofilaments is secured to the top surface of the roof. The polymer monofilaments are heat welded at junctions to form a matrix of tangled monofilaments. The method for ventilating a roof of a building provided by the invention includes installing a web of extruded polymer monofilaments on a top surface of the roof.

23 Claims, 3 Drawing Sheets

(56) References Cited

U.S. PATENT DOCUMENTS 6,256,955 B1 * 7/2001 Lolley ..... E04B 1/7675 52/302.1
6,460,304 B1 * 10/2002 Kim ..... E04D 5/12 52/408
6,487,826 B1 * 12/2002 McCorsley ..... E04D 13/152 52/309.1
6,594,965 B2 * 7/2003 Coulton ..... E04B 1/7046 52/302.1
6,729,807 B1 * 5/2004 Spittle ..... E02D 17/202 405/302.6
6,981,916 B2 * 1/2006 Coulton ..... F24F 7/02 454/365
7,096,630 B1 * 8/2006 Keene ..... E04F 15/20 52/302.1
7,182,688 B2 * 2/2007 Coulton ..... F24F 7/02 454/365
7,430,837 B2 * 10/2008 Hubbard ..... E04D 5/06 52/408
7,730,684 B1 * 6/2010 Keene ..... E04B 1/7061 52/169.5
7,730,685 B1 * 6/2010 Keene ..... E04B 1/7046 52/169.5
8,205,398 B2 * 6/2012 Chich ..... E04D 13/152 52/302.3
8,973,310 B1 * 3/2015 Henderson ..... E04D 13/178 52/302.1
9,556,617 B2 * 1/2017 Preston ..... E04D 13/17
9,624,663 B2 * 4/2017 Wingfield ..... E04B 7/22
9,879,431 B2 * 1/2018 Keene ..... E04D 13/178
2003/0060113 A1 * 3/2003 Christie ..... D04H 1/52 442/364
2003/0070391 A1 * 4/2003 Tachauer ..... A44B 18/0049 52/745.21
2003/0219568 A1 * 11/2003 Nee ..... E04D 13/10 428/138
2004/0045242 A1 * 3/2004 Lake ..... B32B 5/02 52/396.02
2005/0090197 A1 * 4/2005 Coulton ..... F24F 7/02 454/365
2005/0136831 A1 * 6/2005 Coulton ..... F24F 7/02 454/365
2006/0230699 A1 * 10/2006 Keene ..... E04F 15/20 52/480
2007/0011957 A1 * 1/2007 Willert ..... E04D 13/152 52/95
2007/0193167 A1 * 8/2007 Bruce ..... B32B 27/12 52/408
2009/0107073 A1 * 4/2009 Kalkanoglu ..... B32B 15/08 52/411
2010/0229486 A1 * 9/2010 Keene ..... E04F 15/20 52/403.1
2011/0107700 A1 * 5/2011 Keene ..... B32B 5/12 52/403.1
2011/0189940 A1 * 8/2011 Kerwood-Winslow . E04D 13/17 454/365
2011/0217539 A1 * 9/2011 Bonner ..... B01D 67/0006 428/314.2
2011/0271637 A1 * 11/2011 Wingfield ..... E04B 7/22 52/745.05
2012/0183744 A1 * 7/2012 Keene ..... B32B 5/26 428/175
2012/0183746 A1 * 7/2012 Keene ..... B32B 3/06 428/193
2012/0279153 A1 * 11/2012 Keene ..... E04B 1/7046 52/302.1
2014/0020313 A1 * 1/2014 Preston, III ..... E04D 13/172 52/199
2014/0215937 A1 * 8/2014 Zhou ..... D06N 5/00 52/173.1
2015/0068838 A1 * 3/2015 Keene ..... E04F 15/20 181/292
2016/0083881 A1 * 3/2016 Keene ..... D04H 3/16 428/156
2016/0152396 A1 * 6/2016 Keene ..... B65D 81/022 206/588
2016/0177480 A1 * 6/2016 Cady ..... D03D 19/00 442/208
2016/0177573 A1 * 6/2016 Keene ..... E04D 13/178 52/95
2016/0376794 A1 * 12/2016 Keene ..... E04F 15/186 428/41.8
2017/0015042 A1 * 1/2017 Leitch ..... B29C 47/025

* cited by examiner

ROOF VENTILATION SYSTEM AND METHOD

This application claims the benefit under 35 U.S.C. § 119(e) to U.S. Provisional Application No. 62/092,872 filed on Dec. 17, 2014. The application is incorporated herein by reference in its entirety.

FIELD OF INVENTION

The present invention relates generally to roof ventilation, and more particularly to a roof ventilation system and method that includes a web of extruded polymer monofilaments.

BACKGROUND

Ventilation is an important part of roof design. Conventional eave ventilation is made from sheets of metal stamped with vents cut and shaped to allow air to pass through. The installation of these metal vents is expensive and time consuming because these vents have to be added after the eave is built or requires special material built into the sheathing. Additionally, the metal vent does not connect with the air passage way that is often installed as a chute made form impermeable sheets of plastic.

Moreover, ice dams are created when heat escapes from the living area or is passed through conduction to the attic. The heat then warms the surface of the roof and melts any snow that might accumulate. The interior warmth is exacerbated warming the area at the edge of the roof. The area just above is a little colder. That creates a dam at the edge of the roof. The gutter accumulates water, which results in another cold area. The space between warms the snow to a liquid and traps it. This trapped water can lead back into the occupied space.

Finally, conventional roofing design includes installing a membrane under the shingles. The membrane prevents moisture from entering the living space if moisture breaches the shingles. The membrane is typically made from bitumen or butyl rubber sheets. The membrane typically has a film on the top layer but the film must not be slippery since people walk on top of it on the roof.

SUMMARY

The present disclosure provides a roof ventilation system and method that provides ventilation for a roof while further providing simpler ventilation installation, prevention of ice dams, a non-slip surface to walk on, and a secondary membrane to prevent moisture intrusion into the living space or walls. The roof ventilation system provided by the invention includes vertical side walls having a top portion. A roof extends outwardly and beyond the vertical side walls. The roof has a top surface facing away from the vertical side walls and a bottom surface facing the side walls. A web of extruded polymer monofilaments is secured to the top surface of the roof. The polymer monofilaments are heat welded at junctions to form a matrix of tangled monofilaments. The method for ventilating a roof of a building provided by the invention includes installing a web of extruded polymer monofilaments on a top surface of the roof.

In accordance with one aspect of the present disclosure, a roof ventilation system includes: vertical side walls having a top portion; a roof extending outwardly and beyond the vertical side walls, the roof having a top surface facing away from the vertical side walls and a bottom surface facing the side walls; and a web of extruded polymer monofilaments, the polymer monofilaments being heat welded at junctions to form a matrix of tangled monofilaments, the web being secured to the top surface of the roof.

In another embodiment, the membrane is made of rubber, polyvinyl chloride, bitumen, or a mixture of two or more thereof.

In another embodiment, the polymer monofilaments are made of a material selected from polyolefin, polyamide, polyester, polyvinylhalide, polystyrene, polyvinylester, or a mixture of two or more thereof.

In another embodiment, the polymer monofilaments are made of a material selected from polyethylene, polypropylene, or a mixture thereof.

In another embodiment, the polymer monofilaments have an average diameter in the range from 1 mil to 4 mils.

In another embodiment, the web covers the entire top surface of the roof.

In another embodiment, the web covers only a portion of the top surface of the roof, leaving the rest of the top surface of the roof uncovered by the web.

In another embodiment, the web vertically overlies the vertical side walls.

In another embodiment, the thickness of the web is greater near the portion of the web that vertically overlies the vertical side walls than at a portion of the web further away from the vertical side walls.

In another embodiment, the web is secured to the roof with adhesive, staples, nails, screws, or a mixture of two or more thereof.

In another embodiment, the roof ventilation system further includes a fabric layer heat bonded to a side of the web facing the roof.

In another embodiment, the web is a roll material.

In another embodiment, the roof ventilation system further includes a fascia extending downwardly from the portion of the roof that extends past the top portion of the vertical side walls.

In another embodiment, the roof ventilation system further includes a gutter that is farther than the fascia from the vertical side walls.

In another embodiment, the gutter is attached to the side of the fascia facing away from the vertical side walls.

In another embodiment, the web includes a wing.

In another embodiment, the wing extends between the fascia and the gutter.

In another embodiment, the wing extends over the gutter.

In accordance with another aspect of the present disclosure, a method for ventilating a roof of a building includes: installing a web of extruded polymer monofilaments on a top surface of the roof, the polymer monofilaments being heat welded at junctions to form a matrix of tangled monofilaments, wherein: the roof extends outwardly and beyond vertical side walls, the vertical side walls having a top portion; and the top surface faces away from the vertical side walls.

In another embodiment, the web is a roll material installed by rolling out the web onto the top surface of the roof.

The foregoing and other features of the invention are hereinafter described in greater detail with reference to the accompanying drawings.

DETAILED DESCRIPTION

Figure 1:
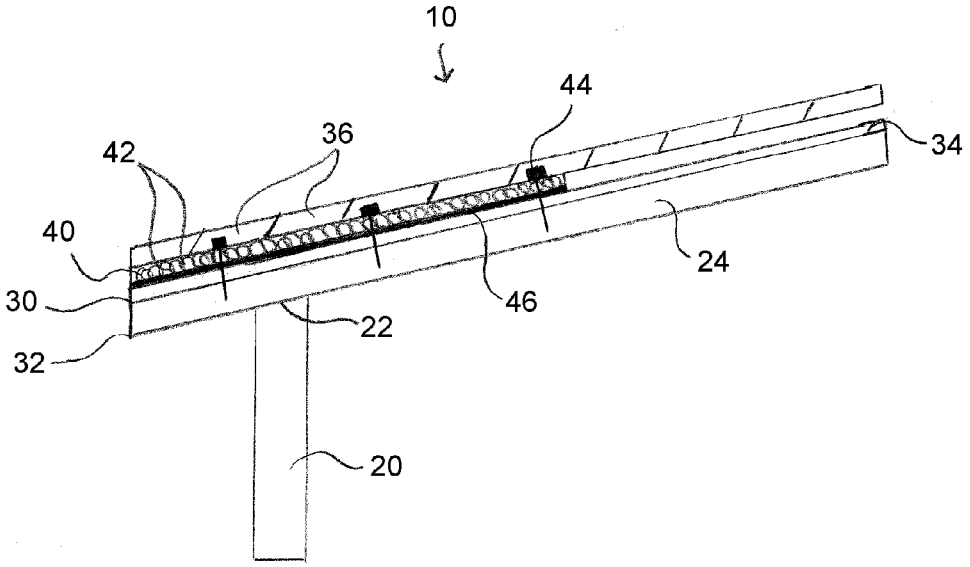
FIG. 1 is a cross-sectional view of an exemplary roof ventilation system according to the disclosure.

In the description that follows, like components have been given the same reference numerals, regardless of whether they are shown in different embodiments. To illustrate an embodiment(s) of the present disclosure in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

An exemplary roof ventilation system includes vertical side walls having a top portion. A roof extends outwardly and beyond the vertical side walls. The roof has a top surface facing away from the vertical side walls and a bottom surface facing the side walls. A web of extruded polymer monofilaments is secured to the top surface of the roof. The polymer monofilaments are heat welded at junctions to form a matrix of tangled monofilaments. An exemplary method for ventilating a roof of a building includes installing a web of extruded polymer monofilaments on a top surface of the roof.

Referring now in detail to the drawings, and initially to FIG. 1, a roof ventilation system is shown at 10. The roof ventilation system 10 includes vertical side walls 20 having a top portion 22. The vertical side walls 20 may be generally constructed of a frame (not shown), a sheathing (not shown), and an external wall covering (not shown).

As shown, a roof 24 extends outwardly and beyond the vertical side walls 20. The roof 24 has a top surface 30 that faces away from the vertical side walls 20. The roof 24 has a bottom surface 32 that faces the vertical side walls 20. While the roof 24 is shown sloped at an angle relative to the vertical side walls 20, the roof 24 may be orthogonal relative to the vertical side walls 20.

In some embodiments, the roof 24 includes rafters (not shown) and sheathing (not shown). The rafters may include a series of sloped beams that extend from the vertical side walls 20. The sheathing may be secured to the side of the rafters facing away from the vertical side walls 20. The sheathing may be made of wood, plywood, oriented-strand board, fiberboard, foam, gypsum board, cardboard, or a mixture of two or more thereof.

As depicted, the roof ventilation system 10 includes a membrane 34 between the web 40 and the top surface 30 of the roof 24. The membrane 34 may be made of rubber, polyvinyl chloride, bitumen, or a mixture of two or more thereof.

As shown, the roof ventilation system 10 includes shingles 36. The shingles 36 are secured to the side of the membrane 34 facing away from the vertical side walls 20. The shingles 36 may be made of wood, slate, flagstone, fibre cement, metal, plastic, composite material, or a mixture of two or more thereof.

As depicted, a web 40 of extruded polymer monofilaments 42 is secured to the top surface 30 of the roof 24. The monofilaments 42 are heat welded at junctions to form a matrix of tangled monofilaments 42. The monofilaments 42 of the web 40 may be made from any thermoplastic polymer that provides the desired property of strength and resilience when included in the roof ventilation system 10. The monofilaments 42 may be made of polyolefin (e.g., polyethylene, polypropylene, etc.), polyamide (e.g., Nylon), polyester, polyvinylhalide (e.g., polyvinylchloride (PVC), polyvinylidene chloride, polyvinyltetrafluoride, polyvinylchlorotrifluoride), polystyrene, polyvinylester (e.g., polyvinyl acetate, etc.), or a mixture of two or more thereof.

The monofilaments 42 are extruded onto a substrate having the desired structural profile to form the web 40. The monofilaments 42 of the web 40 may form a peak and valley structure undulating in the longitudinal and/or traverse directions, preferably to provide a waffle-like structure. Due to its filamentatious structure, the web 40 contains a great number of mutually interconnected voids that allow gases and liquids to flow freely therethrough.

In one example, the monofilaments 42 may have an average diameter in the range of 0.25 mils to 6 mils, or in another example in the range of 0.50 mils to 5 mils, or in another example in the range of 0.75 mils to 4.5 mils, or in another example in the range of 1 mil to 4 mils.

While the web 40 is shown covering only a portion of the top surface 30 of the roof 24, leaving the rest of the top surface 30 of the roof 24 uncovered by the web 40, the web 40 may cover the entire top surface 30 of the roof 24.

As depicted, the web 40 vertically overlies the vertical side walls 20. In some embodiments, the portion of the roof 24 that vertically overlies the vertical side walls 20 is left uncovered by the web 40.

As shown, the thickness of the web 40 is generally uniform over the entire area of the web 40. In some embodiments, the thickness of the web 40 is greater near the portion of the web 40 that vertically overlies the vertical side walls 20 than at a portion of the web 40 further away from the vertical side walls 20.

In one example, the thickness of the web 40 may be in the range of 0.1 inches to 10 inches, or in another example, in the range of 0.1 inches to 5 inches, or in another example in the range of 0.25 inches to 2.5 inches, or in another example in the range of 0.25 inches to 1 inch.

In one example the web 40 may have a height in the range of 1 foot to 20 feet, or in another example in the range of 1 foot to 15 feet inches, or in another example in the range of 1 foot to 10 feet, or in another example 1 foot to 5 feet.

As shown, the web 40 is secured to the roof 24 with fasteners 44. The fasteners 44 may include adhesive, staples, nails, screws, or a mixture of two or more thereof.

As shown, a fabric layer 46 is heat bonded to a side of the web 40 facing the roof 24. The fabric layer 46 may be constructed of fiberglass or a similar material, even more preferably a material displaying resistance to environmental exposure (e.g., alkaline conditions, and the like). In one embodiment, the fabric layer 46 includes a fiberglass layer and a polymer coating. The fiberglass layer 46 may be a woven layer. The fiberglass layer 46 may have a plurality of fiberglass strands extending parallel to one another in a first direction and a plurality of fiberglass strands extending parallel to one another in a second direction orthogonal to the first direction. The fiberglass strands may intersect one another at angles of about 90°. The strands may be aligned in a side-by-side configuration or in an over/under configuration. The polymer coating may provide a binding to hold the strands together in the fabric layer 46.

The fiberglass strands may each comprise a plurality of fiberglass filaments. The fiberglass filaments may be combined with filaments of another material, for example, a polymer such as polyester. The average diameter of the fiberglass strands may be in the range from about 10 to 200 mils, and in one embodiment in the range from about 20 to about 40 mils. The number of fiberglass strands extending in the first direction may be in the range from about 1 to about 20 strands per inch of fabric layer 46 as measured in the second direction, and in one embodiment in the range from about 6 to about 10 strands per inch, and in one embodiment about 7 or 8 strands per inch. The number of fiberglass strands extending in the second direction may be in the range from about 1 to about 20 strands per inch of fabric measured in the first direction, and in one embodiment in the range from about 6 to about 10 strands per inch of fabric layer 46 as measured in the machine direction, and in one embodiment about 7 or about 8 strands per inch.

Figure 2:
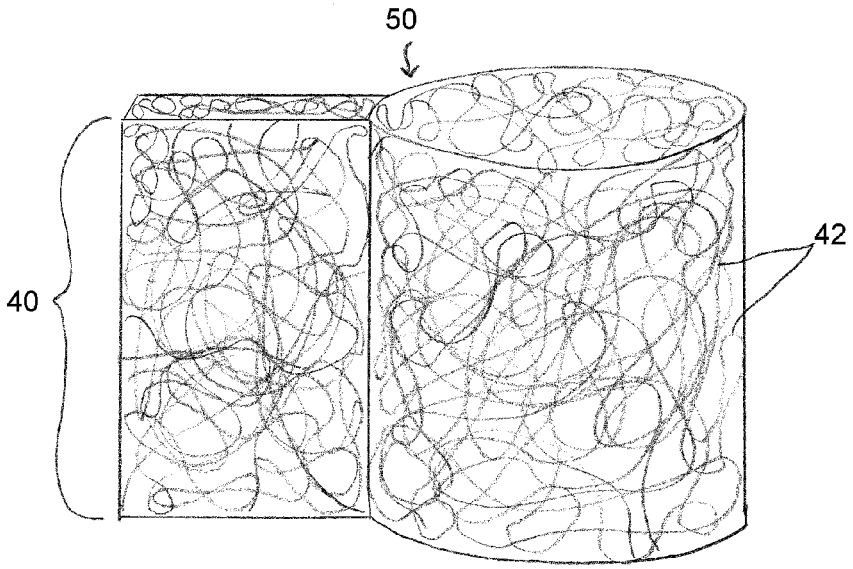
FIG. 2 is an oblique view of the web of FIG. 1 as roll material.

Referring now to FIG. 2, the web 40 (FIG. 1) is a roll material 50. The roll material 50 may include the web 40 rolled onto itself around an axis. The roll material 50 provides for easier installation of the web 40.

In one example, the thickness of the roll material 50 may be in the range of 0.1 inches to 10 inches, or in another example in the range of 0.1 inches to 5 inches, or in another example in the range of 0.25 inches to 2.5 inches, or in another example in the range of 0.25 inches to 1 inch. In one example the roll material 50 may have a height in the range of 1 foot to 20 feet, or in another example the range of 1 foot to 15 feet, or in another example in the range of 1 foot to 10 feet, or in another example in the range of 1 foot to 5 feet. In one example, the roll material 50 may have a length of 5 feet to 75 feet, or in another example in the range of 15 feet to 65 feet, or in another example in the range of 20 feet to 55 feet, or in another example in the range of 25 feet to 50 feet.

Figure 3:
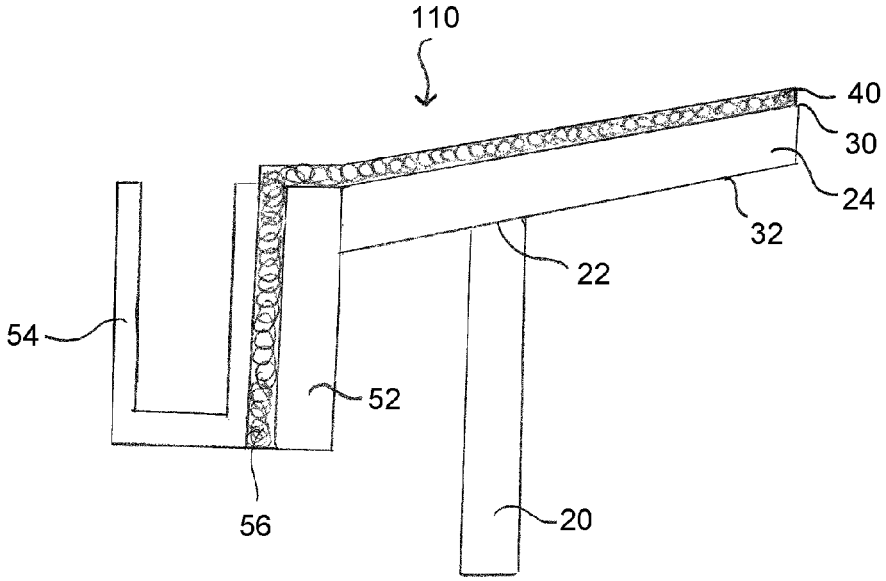
FIG. 3 is a cross-sectional view of an embodiment of the roof ventilation system.

Referring now to FIG. 3 the roof ventilation system 110 includes a fascia 52 extending downwardly from the portion of the roof 24 that extends past the top portion 22 of the vertical side walls 20. While the fascia 52 is shown connected to the roof 24 on a side of the roof 24 that is parallel to the vertical side walls 20, the fascia 52 may be connected to the bottom surface 32 of the roof 24.

As depicted, the roof ventilation system 110 includes a gutter 54 that is farther from the fascia 52 than the vertical side walls 20. The gutter 54 may be made from cast iron, lead, zinc, galvanized steel, painted steel, copper, painted aluminum, vinyl, concrete, stone, wood, or a mixture of two or more thereof.

As shown, the web 40 includes a wing 56. The wing 56 extends from a portion of the web 40 that vertically overlies the vertical side walls 20. The wing 56 extends between the fascia 52 and the gutter 54. As shown, the gutter 54 contacts the wing 56 on a side facing away from the vertical side walls 20. This embodiment allows the wing 56 to act as a gutter guard against the fascia 52 by preventing debris from building up behind the gutter 54.

Figure 4:
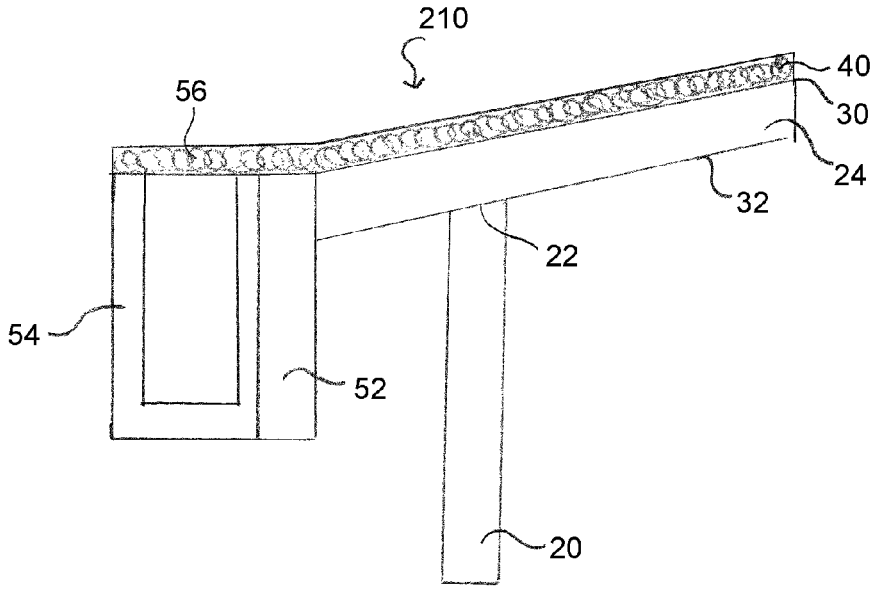
FIG. 4 is a cross-sectional view of another embodiment of the roof ventilation system.

Turning now to FIG. 4, the roof ventilation system 210 includes a wing 56 extends over the gutter 54. While the gutter 54 is shown attached to the side of the fascia 52 facing away from the vertical side walls 20, the gutter 54 may be attached to the side of the fascia 52 facing the roof 24 or to the side of the fascia 52 facing away from the roof 24. By extending the wing 56 over the top of a gutter 54, the wing 56 acts as a drainage device for moisture that might back up from the gutter 54. Relieving moisture from accumulating on the top surface 30 of the roof 24 would assist in controlling ice dam formation.

In some embodiments, a method for ventilating a roof of a building includes installing a web 40 of extruded polymer monofilaments 42 on a top surface 30 of the roof 24. The roof 24 extends outwardly and beyond vertical side walls 20. The vertical side walls 20 have a top portion 22. The top surface 30 faces away from the vertical side walls 20.

In some embodiments, the web 40 may be installed to cover the entire top surface 30 of the roof 24. The web 40 may be installed to cover only a portion of the top surface 30 of the roof 24, leaving the rest of the top surface 30 of the roof 24 uncovered by the web 40. The web 40 may be installed to vertically overlie the vertical side walls 20. The installation of the web 40 may include securing the web 40 to the top surface 30 of the roof 24 with adhesive, staples, nails, screws, or a mixture of two or more thereof.

Figure 5:
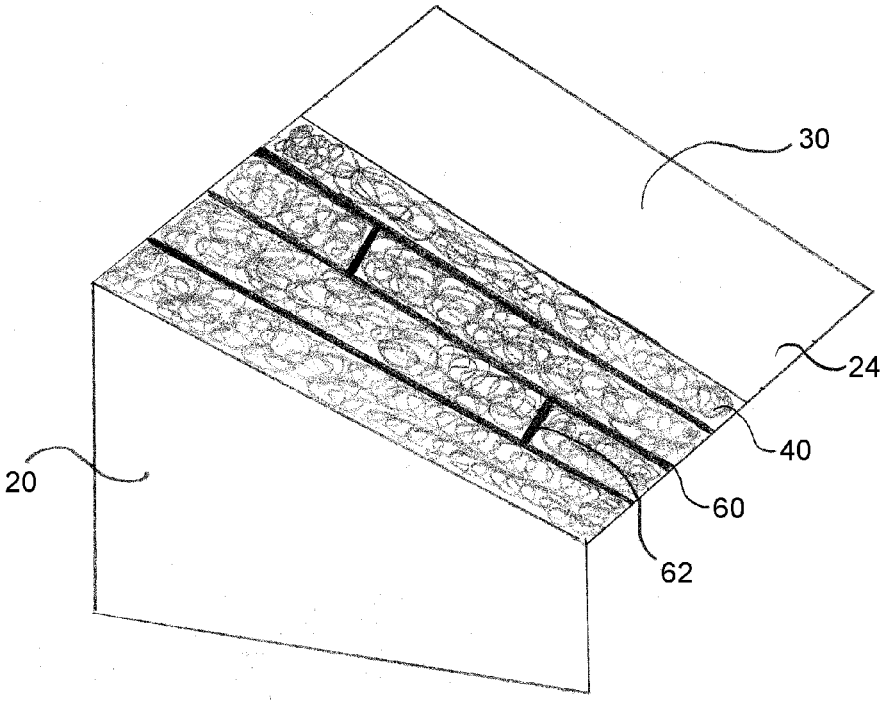
FIG. 5 is an oblique view of an embodiment of a method of ventilating a roof.

Referring now to FIG. 5, the web 40 is a roll material 50 installed by rolling out the web 40 onto the top surface 30 of the roof 24. The web 40 may be unrolled from the roll and applied so that the web 40 overlies and extends the length of the corresponding vertical side wall 20. Additional rolls of web 40 may be installed progressively higher on the roof 24 with each additional height of web 40 overlapping the roll below to create an overlap zone 60. When, during installation, the end of a roll is reached, the terminal end of the roll may be joined to the initial end of another such roll by forming another overlap zone 62.

Figure 6:
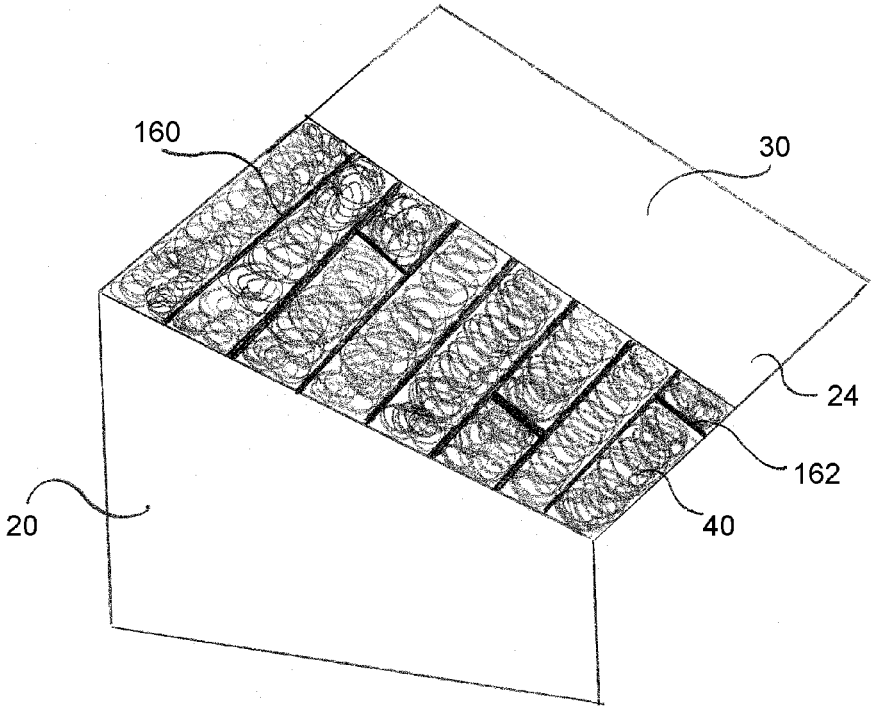
FIG. 6 is an oblique view of another embodiment of a method of ventilating a roof.

Turning now to FIG. 6, the web 40 is unrolled from the roll material 50 and applied so that the web 40 overlies and extends perpendicular to the corresponding vertical side wall 20. Additional rolls may be installed parallel to this roll to create an overlap zone 160. When, during installation, the end of a roll is reached, the terminal end of the roll may be joined to the initial end of another such roll by forming another overlap zone 162.

In some embodiments, the method may further include installing a membrane 34 between the web 40 and the top surface 30 of the roof 24. Installing the web 40 on top of the membrane 34 would prevent slipping while creating a little space for ventilation. Moreover, the web 40 would have the added benefit of the secondary membrane to prevent moisture intrusion into the living space or walls. The method may further include heat bonding a fabric layer 46 to the web 40. The web 40 may be installed such that the fabric layer 46 contacts the top surface 30 of the roof 24.

In some embodiments, the method further includes installing a gutter 54 farther away than the fascia 52 from the vertical side walls 20. The gutter 54 may be installed to the side of the fascia 52 facing away from the vertical side walls 20. The web 40 may include a wing 56 that is installed between the fascia 52 and the gutter 54. The web 40 may include a wing 56 that is installed over the gutter 54.

The present disclosure provides a roof ventilation system and method that provides ventilation for a roof while further providing a non-slip surface to walk on and secondary membrane to prevent moisture intrusion into the living space or walls. The roof ventilation system 10 provided by the invention includes vertical side walls 20 having a top portion 22. A roof 24 extends outwardly and beyond the vertical side walls 20. The roof 24 has a top surface 30 facing away from the vertical side walls 20 and a bottom surface 32 facing the vertical side walls 20. A web 40 of extruded polymer monofilaments 42 is secured to the top surface 30 of the roof 24. The polymer monofilaments 42 are heat welded at junctions to form a matrix of tangled monofilaments 42. The method for ventilating a roof of a building provided by the invention includes installing a web 40 of extruded polymer monofilaments 42 on a top surface 30 of the roof 24.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A roof ventilation system comprising:

vertical side walls having a top portion;

a roof extending outwardly and beyond the vertical side walls, the roof having a top surface facing away from the vertical side walls and a bottom surface facing the side walls;

a fascia extending downwardly from a portion of the roof that extends beyond the vertical side walls;

a gutter secured to the fascia;

a web of extruded polymer monofilaments, the polymer monofilaments being heat welded at junctions resulting in a matrix of tangled, randomly spaced monofilaments having mutually interconnected voids that allow gases and liquids to freely flow therethrough, the web being secured to the top surface of the roof; and wherein the web includes a wing that extends over the gutter.

2. The roof ventilation system of claim 1, further including a membrane between the web and the top surface of the roof.

3. The roof ventilation system of claim 1, further comprising a fabric layer heat bonded to a side of the web facing the roof.

4. The roof ventilation system of claim 1, wherein the web covers the entire top surface of the roof.

5. The roof ventilation system of claim 1, wherein the polymer monofilaments are made of a material selected from polyolefin, polyamide, polyester, polyvinylhalide, polystyrene, polyvinylester, or a mixture of two or more thereof.

6. The roof ventilation system of claim 1, wherein the polymer monofilaments are made of a material selected from polyethylene, polypropylene, or a mixture thereof.

7. The roof ventilation system of claim 1, wherein the polymer monofilaments have an average diameter in the range from 1 mil to 4 mils.

8. The roof ventilation system of claim 1, wherein the web is secured to the roof with adhesive, staples, nails, screws, or a mixture of two or more thereof.

9. The roof ventilation system of claim 1, wherein the web is a roll material.

10. The roof ventilation system of claim 1, wherein the web covers only a portion of the top surface of the roof, leaving the rest of the top surface of the roof uncovered by the web.

11. The roof ventilation system of claim 10, wherein the web vertically overlies the vertical side walls.

12. The roof ventilation system of claim 11, wherein a thickness of the web is greater near the portion of the web that vertically overlies the vertical side walls than at a portion of the web further away from the vertical side walls.

13. A roof ventilation system comprising:

vertical side walls having a top portion;

a roof extending outwardly and beyond the vertical side walls, the roof having a top surface facing away from the vertical side walls and a bottom surface facing the side walls;

a fascia extending downwardly from a portion of the roof that extends beyond the vertical side walls;

a gutter secured to the fascia;

a web of extruded polymer monofilaments, the polymer monofilaments being heat welded at junctions resulting in a matrix of tangled, randomly spaced monofilaments having mutually interconnected voids that allow gases and liquids to freely flow therethrough, the web being secured to the top surface of the roof;

a membrane positioned between the web and the top surface of the roof; and wherein the web includes a wing that one of (i) extends between the fascia and the gutter or (ii) extends over the gutter.

14. The roof ventilation system of claim 13, further comprising a fabric layer heat bonded to a side of the web facing the roof.

15. The roof ventilation system of claim 13, wherein the web covers the entire top surface of the roof.

16. The roof ventilation system of claim 13, wherein the web is secured to the roof with adhesive, staples, nails, screws, or a mixture of two or more thereof.

17. The roof ventilation system of claim 13, wherein the web is a roll material.

18. The roof ventilation system of claim 13, wherein the polymer monofilaments are made of a material selected from polyolefin, polyamide, polyester, polyvinylhalide, polystyrene, polyvinylester, or a mixture of two or more thereof.

19. The roof ventilation system of claim 13, wherein the polymer monofilaments are made of a material selected from polyethylene, polypropylene, or a mixture thereof.

20. The roof ventilation system of claim 13, wherein the polymer monofilaments have an average diameter in the range from 1 mil to 4 mils.

21. The roof ventilation system of claim 13, wherein the web covers only a portion of the top surface of the roof, leaving the rest of the top surface of the roof uncovered by the web.

22. The roof ventilation system of claim 21, wherein the web vertically overlies the vertical side walls.

23. The roof ventilation system of claim 22, wherein a thickness of the web is greater near the portion of the web that vertically overlies the vertical side walls than at a portion of the web further away from the vertical side walls.

* * * * *